US007878372B1

(12) United States Patent
Camejo

(10) Patent No.: US 7,878,372 B1
(45) Date of Patent: Feb. 1, 2011

(54) AUTOMATIC WATER COOLER REPLENISHING SYSTEM

(76) Inventor: Esteban Camejo, P.O. Box 126606, Hialeah, FL (US) 33012

( * ) Notice: Subject to any disclaimer, the term of this patent is extended or adjusted under 35 U.S.C. 154(b) by 414 days.

(21) Appl. No.: 12/044,276

(22) Filed: Mar. 7, 2008

(51) Int. Cl.
*B67D 1/00* (2006.01)

(52) U.S. Cl. ..... 222/64; 222/1; 222/67; 222/146.1; 222/146.6; 222/185.1; 222/464.3; 141/18; 141/198

(58) Field of Classification Search ..... 222/1, 222/52, 56, 64–67, 129.1, 146.1, 146.6, 185.1, 222/464.1, 464.3; 141/2, 18, 198
See application file for complete search history.

(56) References Cited

U.S. PATENT DOCUMENTS 3,495,612 A * 2/1970 Learn et al. ..... 137/209
3,653,413 A * 4/1972 Sheya ..... 141/1
4,030,634 A * 6/1977 Osborn ..... 222/23
5,495,725 A * 3/1996 Middlemiss ..... 62/389
5,607,000 A * 3/1997 Cripe et al. ..... 141/21
6,209,753 B1 * 4/2001 Ohu ..... 222/64
6,453,955 B1 * 9/2002 Lee ..... 141/198
6,793,099 B1 * 9/2004 Sleiman ..... 222/67
7,044,175 B1 * 5/2006 Camejo ..... 141/18
7,124,913 B2 * 10/2006 Birtcher et al. ..... 222/64
7,131,556 B2 * 11/2006 Tseng ..... 222/64
7,597,215 B2 * 10/2009 Sleiman ..... 222/65

* cited by examiner

*Primary Examiner*—Frederick C. Nicolas
(74) *Attorney, Agent, or Firm*—Gold & Rizvi, P.A.; H. John Rizvi; Glenn E. Gold

(57) ABSTRACT

An automatic water cooler replenishing system for a free standing water cooler, having an internal reservoir. The system includes a pump having an inlet port and an outlet port configured for collecting water from a supply bottle and dispensing water into the reservoir. The pump is selectively powered and automatically controlled. A relay is provided for automatically controlling the operation of the pump. The relay is configured to receive an electric signal and control the pump. A fill control assembly and a low water shut-off assembly are electrically connected to the relay. The fill control assembly is configured to detect at least one water level, in the reservoir and signal the relay to energize or de-energize the pump. The low water shut-off assembly is configured to detect a low water condition in the supply bottle and signal the relay to de-energize the pump.

11 Claims, 7 Drawing Sheets

AUTOMATIC WATER COOLER REPLENISHING SYSTEM

BACKGROUND OF THE INVENTION

1. Field of the Invention

The present invention generally relates to freestanding water coolers having internal reservoirs fed by inverted conventional supply bottles and more particularly to systems for replenishing the supply of water in the water cooler.

2. Description of the Prior Art

Most modern buildings are served by water systems which include a network of pipes disposed within the walls and floors, such that potable water is available at most locations throughout the building; however, there are circumstances which require the use of freestanding water coolers to serve the need for readily available drinking water. Office buildings or buildings which have been converted to use as offices, are frequently divided into relatively small spaces to suit the needs of small business operations. It is not uncommon for such an office to install a freestanding water cooler rather than a water fountain of the type which must be connected to the building plumbing system, in order to provide drinking water for employees. In addition, certain industrial sites are located where drinking water is not available through a building plumbing system. Also, some offices and households have opted for bottled water, for drinking, even though potable water service is otherwise available. For a variety of reasons, offices and households install water coolers and subscribe to a service which delivers bottled water, for use with the water coolers.

Typically, the water is delivered in bottles having a five gallon capacity. The bottles are typically formed of plastic having an upper portion with a tapered upwardly extending neck, which includes an opening at the distal end. Water coolers are typically formed with a tapered well at their top, corresponding to the shape of the upper portion of the water bottle and designed to receive an inverted bottle in a stable supporting relation. An opening, communicating with a reservoir inside the water cooler, is provided at a lowermost portion of the well. As the water cooler is tapped, the reservoir is replenished from the bottle, by water descending through the opening. When the water, in a bottle is consumed, the empty bottle is removed from the well. A replacement supply bottle is opened and inverted as it is placed into the well. The full water bottle is heavy and unwieldy. It must be inverted and placed in the well, after the top has been opened. There is a potential for an accident involving a dropped bottle and also the potential of a water spill, which could damage property or cause a slippery condition of the floor. There is a need for a system which can automatically refill a freestanding water cooler without the necessity of lifting a full bottle and inserting the then open bottle into the well at the top of the water cooler.

SUMMARY OF THE INVENTION

The present invention comprises a system and a process for automatically replenishing a freestanding water cooler, from a conventional supply bottle without the need for lifting and inserting a heavy supply bottle. The system of the present invention includes an automatically controlled pump, an inlet port and an outlet port. The inlet port and the outlet port are operably connected to the pump for urging water inward from the inlet port and outward through the outlet port. Selective power means and automatic control means are provided for operating the pump. Means for collecting water from a conventional supply bottle and a fill control assembly for dispensing water into the reservoir are provided. Means for collecting water are connected in watertight fluid communication with the inlet port of the pump. The fill control assembly is connected in fluid communication with the outlet port of the pump and positioned within the water cooler reservoir for delivering water.

Selective power means for the pump include a switch for selectively powering the pump and automatic control means include with a relay for automatically controlling the pump. The fill control assembly is configured to detect at least one pre-selected quantity of water in the reservoir and to transmit a signal to the relay to control the pump when the water quantity reaches a pre-selected amount.

The pump may be powered under operative control of the fill control assembly to collect and deliver the water, from the conventional supply bottle to the reservoir of the water cooler. In this manner, the water cooler may be automatically replenished with a supply of water, in a pre-selected quantity, without the necessity of lifting and inverting a full bottle of water. When the supply bottle is emptied, a new full supply bottle may be substituted, by transferring the means for collecting water and the system may be used to continuously replenish the water cooler, without the need for removing and replacing an inverted bottle on the water cooler.

In addition, the means for collecting water may include a low water shut-off assembly submerged in the supply bottle and configured to detect a quantity of water, in the supply bottle, transmit a signal to the relay and de-energize the pump when the water quantity decreases to a pre-selected amount, for preventing damage to the pump.

It is an object of the present invention to provide a water cooler replenishing system which is capable of replenishing the supply of water in a freestanding water cooler.

It is a further object of the present invention to provide a water cooler replenishing system capable of automatically replenishing the supply of water, in a water cooler, without the necessity of lifting or inverting the full water bottle.

It is another object of the present invention to provide a water cooler replenishing system capable of automatically replenishing the supply of water in a water cooler and capable of shutting off when a supply bottle is empty.

It is yet another object of the present invention to provide a water cooler replenishing system capable of automatically replenishing the supply of water in a freestanding water cooler without the necessity of moving a supply water bottle to a location immediately proximate to the water cooler.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Shown throughout the drawings, the present invention is generally directed toward a system for automatically replenishing a freestanding water cooler from a supply source. The system of the present invention is capable of transferring water to the water cooler without the necessity of lifting a bottle of water and placing it within the well, at the top of the water cooler.

Figure 1:
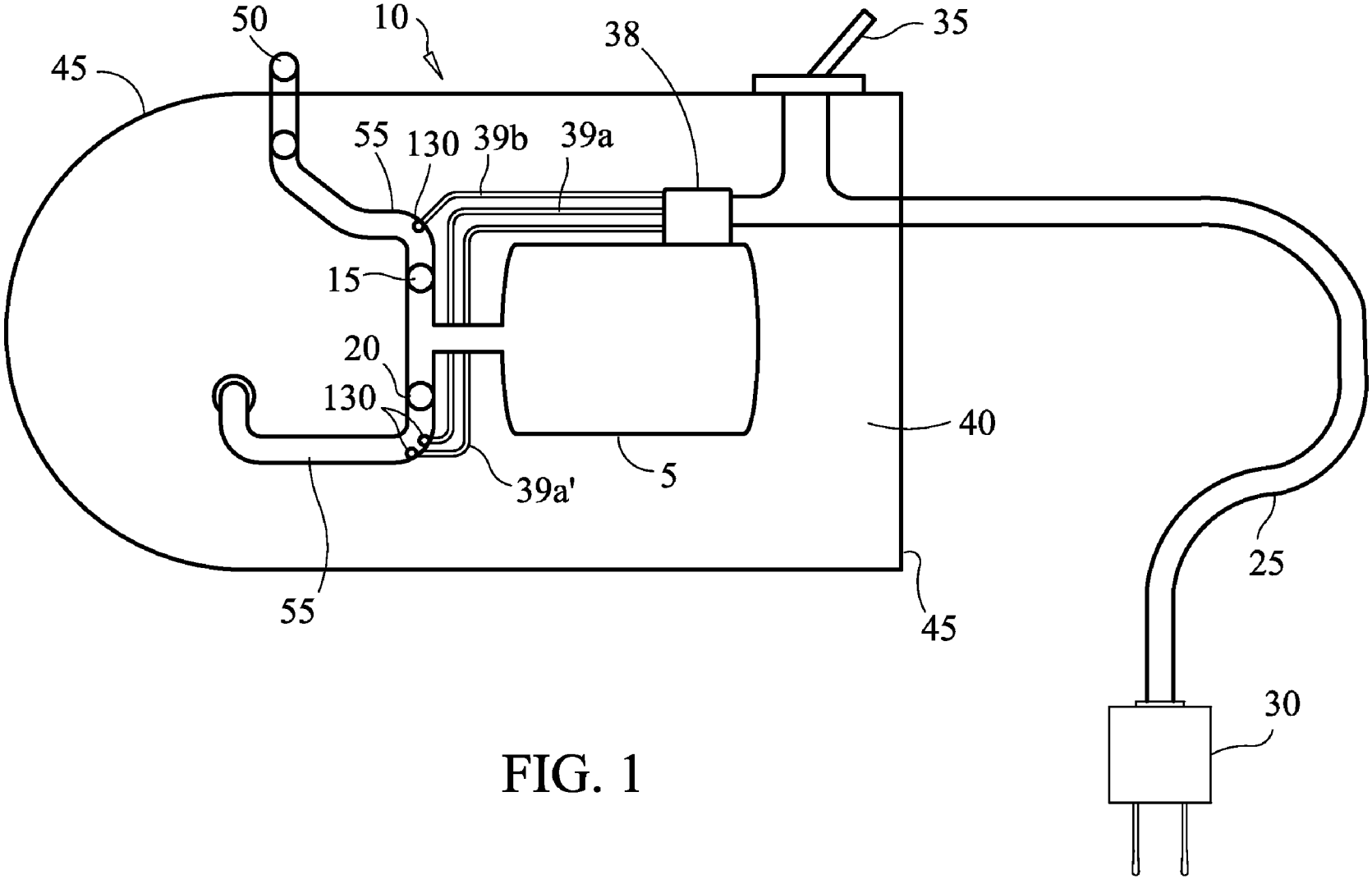
FIG. 1 is a plan view of the pump with the housing top removed.

The system of the present invention includes a fluid pump 5, which for aesthetic and noise reduction purposes, may be disposed within a housing 10, as shown in FIG. 1. The pump 5, is provided with an inlet port 15 and an outlet port 20, both of which are operably connected to the pump 5 and configured for urging water inward from the inlet port 15 and outward through the outlet port 20. It is preferred that the pump 5 should be electrically powered and have sufficient capacity to transfer water to a container located approximately five feet above the collection point. It may be appreciated that the selection of a relatively low capacity pump will reduce the size and weight of the present invention. Commercially available pumps, which are energized by direct current power, using a conventional power cord 25 and adapter 30 connected to standard 115-120 volt household outlet, are available in a range of capacities, and are suitable for use in the present invention. An alternate embodiment of the present invention may be provided with various power cords (not shown) to allow connection to other sources of electric power, for example marine power supplies, standard alternating current, or batteries. Means for selectively powering the pump 5 are preferably provided by a switch 35 wired to power the pump 5, when the switch 35 is open.

Figure 2:
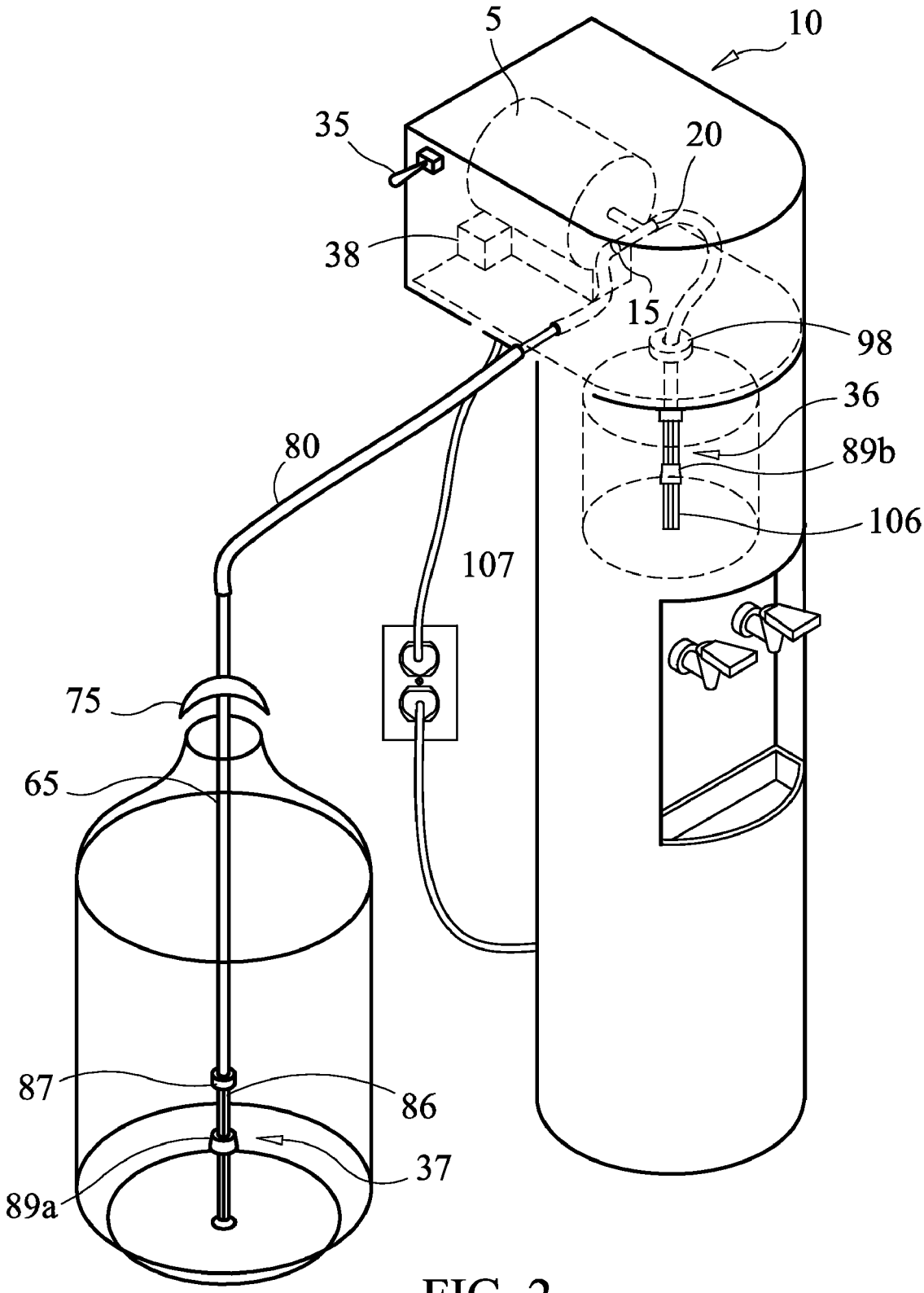
FIG. 2 is a front perspective view of the system of the present invention, with a supply tube in a supply bottle, with the pump positioned on a water cooler, and with the fill control assembly in the internal reservoir of the water cooler, shown in phantom lines.
Figure 3A:
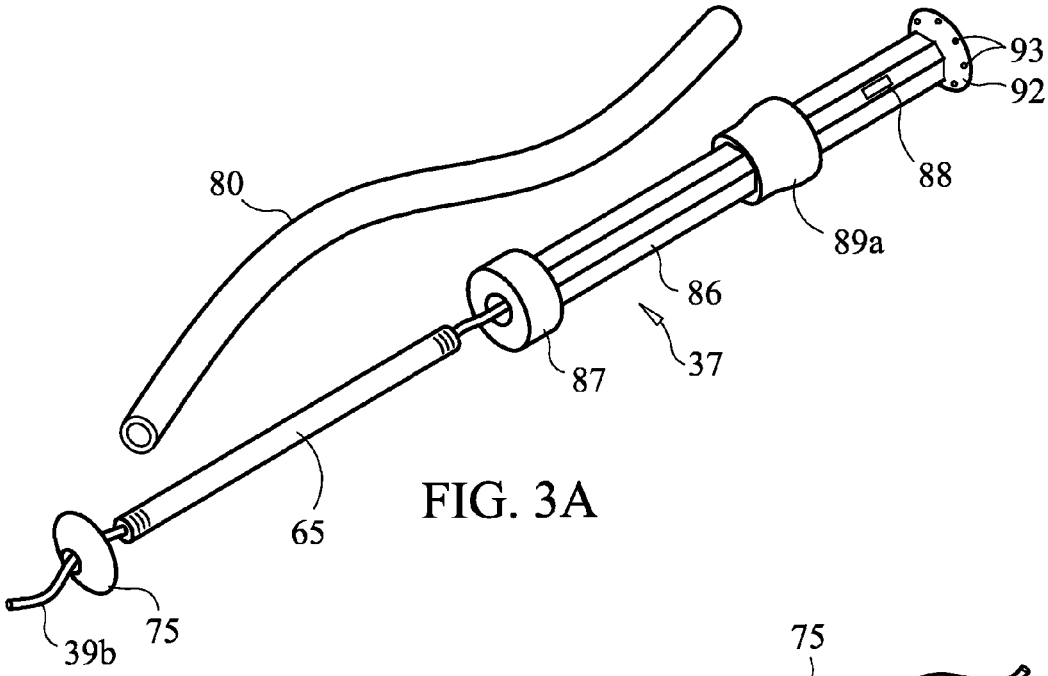
FIG. 3A is a side perspective view of a low water shut-off assembly, a supply tube, a collar, and a supply hose, all separated, for convenient viewing.
Figure 3B:
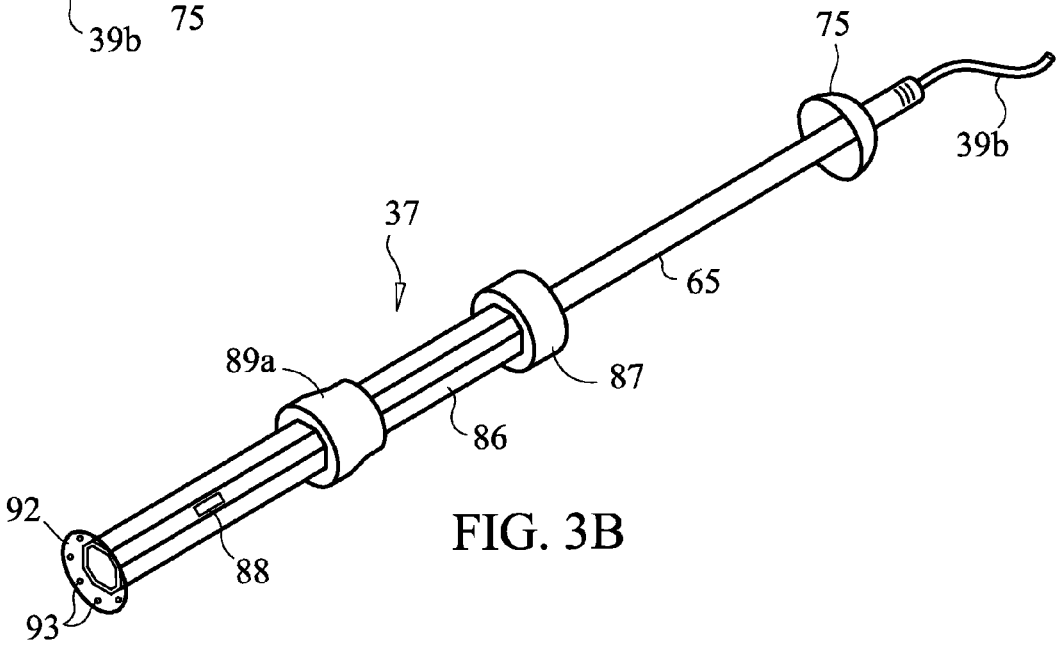
FIG. 3B is a bottom perspective view of a low water shut-off assembly mounted on the distal end of a supply tube.

The system includes a fill control assembly 36, shown in FIG. 2, for dispensing water into the reservoir and water collecting means which preferably also includes a low water shut-off assembly 37 shown in FIGS. 2, 3A, and 3B. As shown in FIG. 1, a relay 38 is mounted adjacent to the pump 5. The power cord 25 is electrically connected, through the switch 35, to the relay 38. The relay 38 is preferably configured, in a conventional manner, to energize and to de-energize the pump 5 automatically as controlled by a signal received through a plurality of pairs of wires; namely, first and second pairs of fill control assembly wires 39*a* and 39*a'* and a pair of low water shut-off assembly wires 39*b*, as shown in FIG. 1. The pairs of wires are electrically connected to the relay 38 and, provided the switch 35 is open, carry a signal to automatically control operation of the pump 5.

It is preferred that the pump 5 be mounted on a platform 40 formed of a flat rigid sheet of material such as metal or wood. Mounting may be accomplished by conventional means, such as by screws. It is preferred that a housing 10 be provided to conceal the pump 5 from view and to muffle the noise. The housing 10 comprises a plurality of co-joined walls 45, attached to the edges of the platform 40 in generally perpendicular orientation and extending upward from the platform 40 for surrounding the pump 5. The same type of material selected for forming the platform 40 may be used for forming the walls 45.

The inlet port 15 and the outlet port 20 are preferably fitted with extensions each comprising a rigid distal sleeve 50 and a flexible segment 55. Each distal sleeve 50 is preferably formed of metal or plastic and each flexible segment 55 is preferably formed of rubber tubing or plastic tubing. Each distal sleeve 50 is designed to fit snugly within the flexible segment 55 to form a watertight connection providing a fluid conduit. Each flexible segment 55 is sized to connect to the pump 5 by sliding onto one of the inlet port 15 or the outlet port 20 to form watertight connections providing fluid conduits.

Apertures are provided in the walls 45 to provide passages for the power cord 25. An aperture is provided for the wiring of the switch 35 in a like manner, so that the switch 35 may be operated from outside the housing 10. Apertures are provided, in the housing 10, for the extensions so that the inlet port 15 and the outlet port 20 may be accessed from outside the housing. It is preferred that the aperture for the extension leading to the inlet port 15 is located in one of the walls 45 and that the aperture for the extension leading to the outlet port 20 is located in the platform 40. All of the apertures are lined with throughput fittings to retain the power cord 25, the wiring, and the extensions in a fixed position within the respective apertures. The housing 10 also includes a top, not shown, which may be designed to fit onto the walls 45 opposite the platform 40, for aesthetic purposes and for noise control.

The system of the present invention is depicted in place with a conventional freestanding water cooler, in FIG. 2. Preferably, for convenience, the platform 40 is sized and configured to rest on top of the water cooler. It will be appreciated that the extension leading from the outlet port 20 may be modified in a conventional manner to allow placement of the housing 10 on any convenient support surface. It will also be appreciated that the housing 10 including the pump 5 may be conveniently lifted from the water cooler for cleaning or replacement.

The system includes means for collecting water from a conventional supply bottle, such as a supply tube 65, a stop means, and a supply hose 80. The means for collection water preferably also includes the low water shut-off assembly 37. The supply tube 65 and low water shut-off assembly 37, are shown inside a conventional supply bottle, in FIG. 2. The supply tube 65 is preferably formed of rigid material such as plastic and has a proximal and distal ends. The supply tube 65 and low water shut-off assembly 37 have a cross sectional area sufficiently small to pass through the opening of a conventional water cooler supply bottle, as shown in FIG. 2. The low water shut-off assembly 37 is preferably mounted on the distal end of the supply tube 65. The supply tube 65 has sufficient length to extend from the low water shut-off assembly 37, positioned proximate to the bottom of a conventional water cooler supply bottle, to a point above the opening, as shown in FIG. 2. The supply tube 65 is preferably provided with a stop means, such as an adjustable collar 75. The adjustable collar 75 is sized to contact the periphery of the opening at the top of a conventional water cooler supply bottle and support the supply tube 65 and low water shut-off assembly 37, in a generally vertical orientation, when the supply tube 65 is inserted through the opening, as shown in FIG. 2. The collar 75 is preferably positioned to prevent contact between the low water shut-off assembly 37 and the bottom of the bottle. The stop means also serves to isolate the proximal end of the supply tube 65, which is typically handled manually, from the distal end, which touches the drinking water. In an alternate version of the present invention, the stop means may be an integral transverse collar on an alternate supply tube at an intermediate location pre-selected so as to position the low water shut-off assembly 37 proximate to the bottom of a supply bottle, when the alternate supply tube is inserted to the limiting point defined by the integral collar contacting the neck of the supply bottle. The adjustable collar 75, is preferably formed of flexible material, such as rubber and is provided with a central aperture matching the size of the outside circumference of the supply tube 65, such that the adjustable collar 75, may be forced onto an end of the supply tube 65 and moved to any position along the length of the supply tube 65 where it will be retained in position by frictional engagement between the adjustable collar 75 and the supply tube 65. The position of the adjustable collar 75 may be selected so as to position the low water shut-off assembly 37, at the distal end of the supply tube 65, in appropriate spaced apart relation with respect to the bottom of the supply bottle. A flexible supply hose 80 is included, which is preferably formed of plastic tubing of conventional manufacture and sized to receive the distal sleeve 50 on the extension from the inlet port 15, within one end and the proximal end of the supply tube 65 within the other end, so as to form a watertight fluid conduit from the supply tube 65 to the inlet port 15, as shown in FIG. 2.

Figure 4:
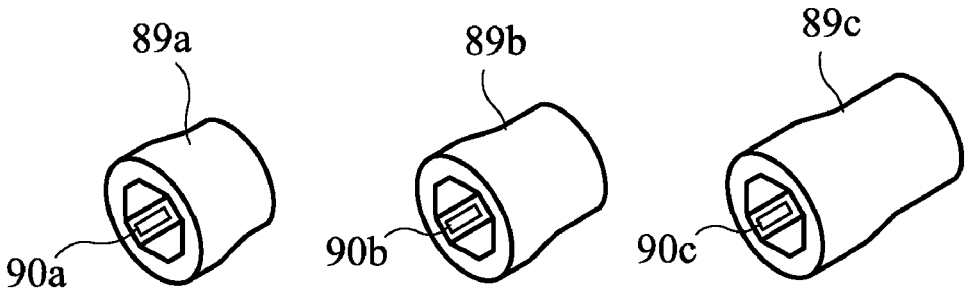
FIG. 4 is a perspective view of three floats.

The low water shut-off assembly 37 preferably includes a tubular supply pipe 86 having proximal and distal ends and having a non-circular outside cross section, such as the hexagonal cross section shown in FIGS. 3A and 3B. A supply coupling 87 having a circular inside cross section is mounted on the proximal end of the supply pipe 86. The supply coupling 87 is designed to receive the distal end of the supply tube 65 in close fitting frictional engagement, such that a watertight fluid conduit is formed from an entry point, at the distal end of the supply pipe 86 into the supply tube 65. The supply pipe 86 is retained in generally vertical orientation inside the supply bottle. A supply sensor 88 is mounted on the exterior surface of the supply pipe 86 and is operably connected to the low water shut-off assembly wires 39*b* extending through the inside of the supply pipe 86. A supply float 89*a*, having a through bore for slidably receiving the supply pipe 86, is shown in FIG. 4. The supply float 89*a*, as well as the other floats discussed below, be formed of foamed polymer or the floats may be a hollow plastic body. The through bore is designed with an hexagonal interior cross section complementing the exterior cross section of the supply pipe 86 so as to allow unrestricted longitudinal sliding motion along the supply pipe 86 but so as to prevent rotation. It is preferred that the supply coupling 87 have an exterior diameter greater than that of the supply pipe 86, so that the supply coupling 87 may act as a stop for the supply float 89*a*. The supply float 89*a* may be stopped at the distal end of the supply pipe 89 be a supply foot 92, as shown in FIGS. 3A and 3B. The supply foot 92 may be provided with one or more vents 93 for allowing water to flow into the distal end of the supply pipe 86, in the event that the supply pipe 86 makes contact with the bottom of the supply bottle. The first float 89*a* includes means for inducing the supply sensor 88 to transmit a signal, such as a first magnet 90*a* mounted inside the through bore and positioned for passing proximate to the supply sensor 88, during the passage of the supply float 89*a* along the supply pipe 86, as shown in FIGS. 3A and 3B.

It is intended that the supply tube 65, having the low water shut-off assembly 37 mounted at the distal end would be inserted into a full supply bottle, as shown in FIG. 2. A water level, in the supply bottle, above the supply coupling 87 would cause the first float 89*a* to remain in contact with the supply coupling 87. A decrease in the water level below the supply coupling 87 would cause the supply float 89*a* to descend along the supply pipe 86, bringing the first magnet 90*a* closer to the supply sensor 88. It is intended that the supply sensor 88 and the first magnet 90*a* be configured in conventional manner so that the close proximity of the first magnet 90*a* would induce the supply sensor 88, to transmit a signal through the low water shut-off assembly wires 39*b* to the relay 38. The relay 38 is configured in conventional manner, to receive the signal and to shut off the pump 5. The supply sensor is positioned so as to shut off the pump 5, when the water, in the supply bottle, reaches a pre-selected level.

The first magnet 90*a* is preferably a permanent magnet and the supply sensor 88 is preferably an electric current biased switch configured to react to movement of a magnet within the electric field generated by the switch and initiate a signal. Other conventional means for initiating an electric signal from a sensor are suitable for shutting off the pump 5 upon detecting a low water condition.

The fill control assembly 36 preferably comprises a filler tube 95, which may be formed in the same manner as the supply tube 65 and having proximal and distal ends. The filler tube 95 being designed to have a cross sectional area sufficiently small to pass through the opening, of the water cooler, communicating with the reservoir. It is preferred that the proximal end be connected with the distal sleeve 50 of the extension from the outlet port 20, forming a watertight fluid conduit from the outlet port 20 to the distal end of the filler tube 95. It is preferred that the housing 10 rest on top of the water cooler, as shown in FIG. 2, such that the filler tube 95 may extend downward from the distal sleeve 50, and through the opening, into the reservoir. It is preferred that the fill control assembly 36 be mounted on the distal end of the filler tube 95. A circular gasket 98 is provided to surround the filler tube 95 and cover the opening, for preventing the entry of foreign matter to the reservoir.

Figure 5A:
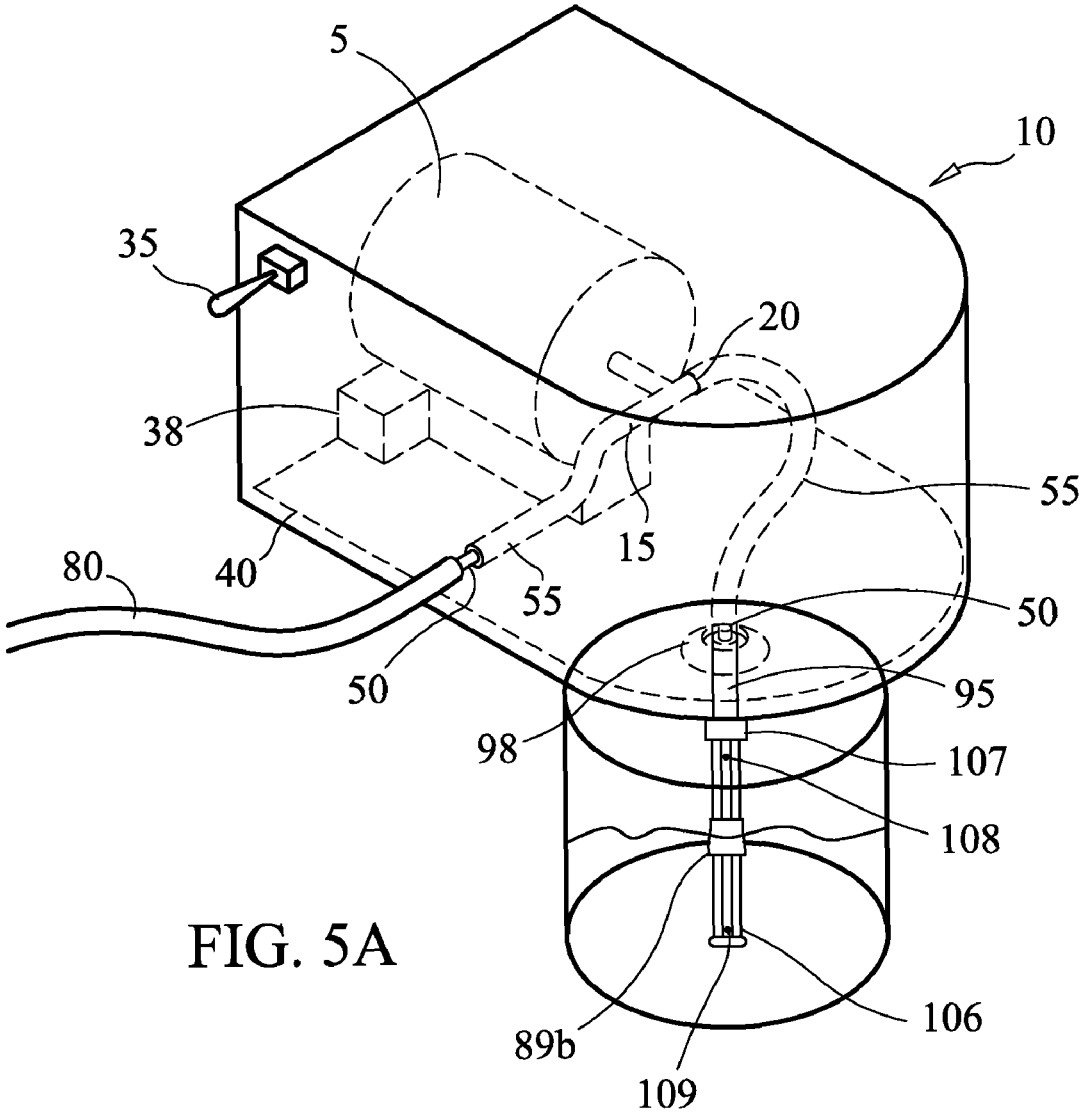
FIG. 5A is a perspective view of the pump and filler assembly of the system of the present invention with the pump shown in phantom lines and fill control assembly visible in a transparent reservoir of a water cooler.
Figure 5B:
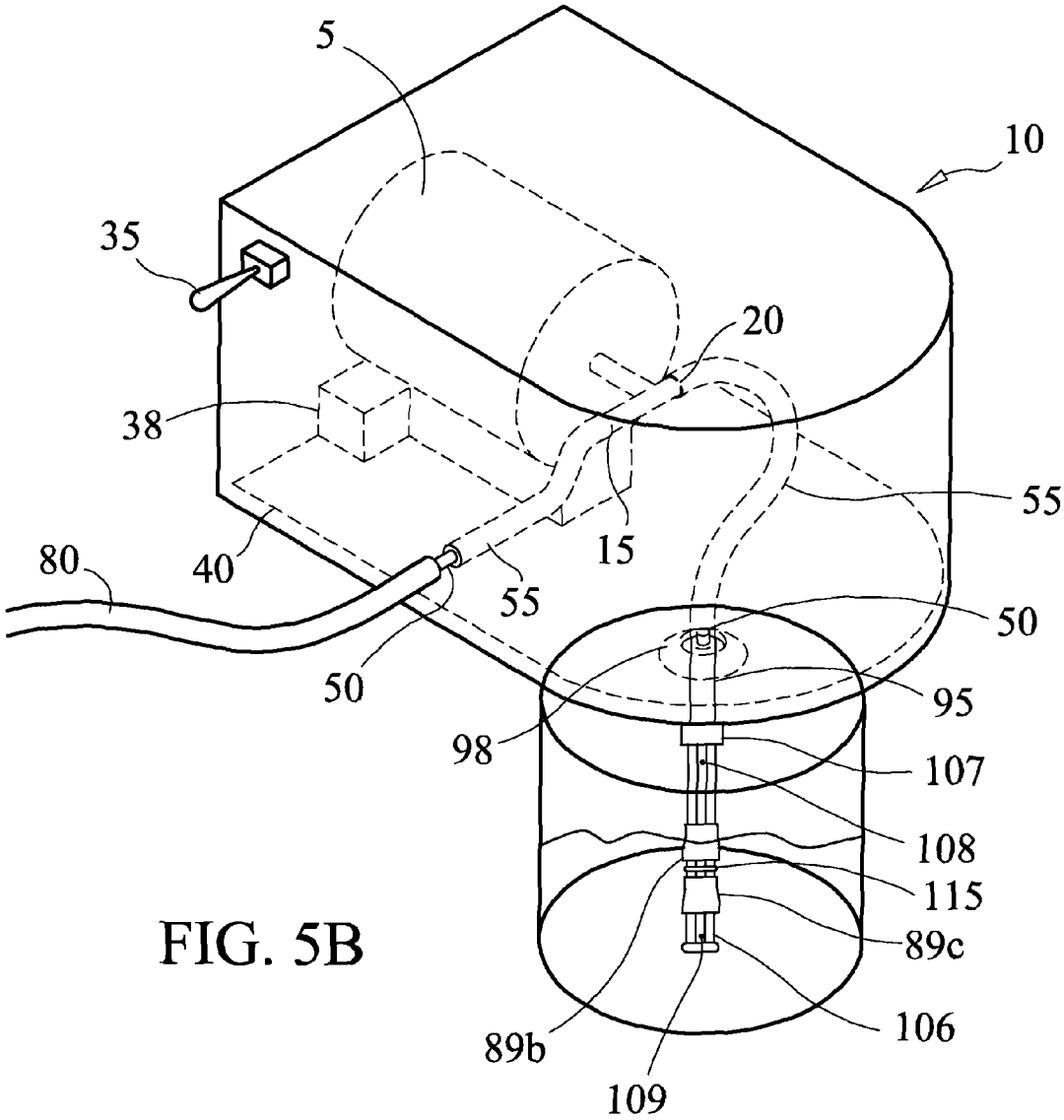
FIG. 5B is a perspective view of the pump and an alternate embodiment of the fill control assembly of the system of the present invention with the pump shown in phantom lines and fill control assembly visible in a transparent reservoir of a water cooler.
Figure 6A:
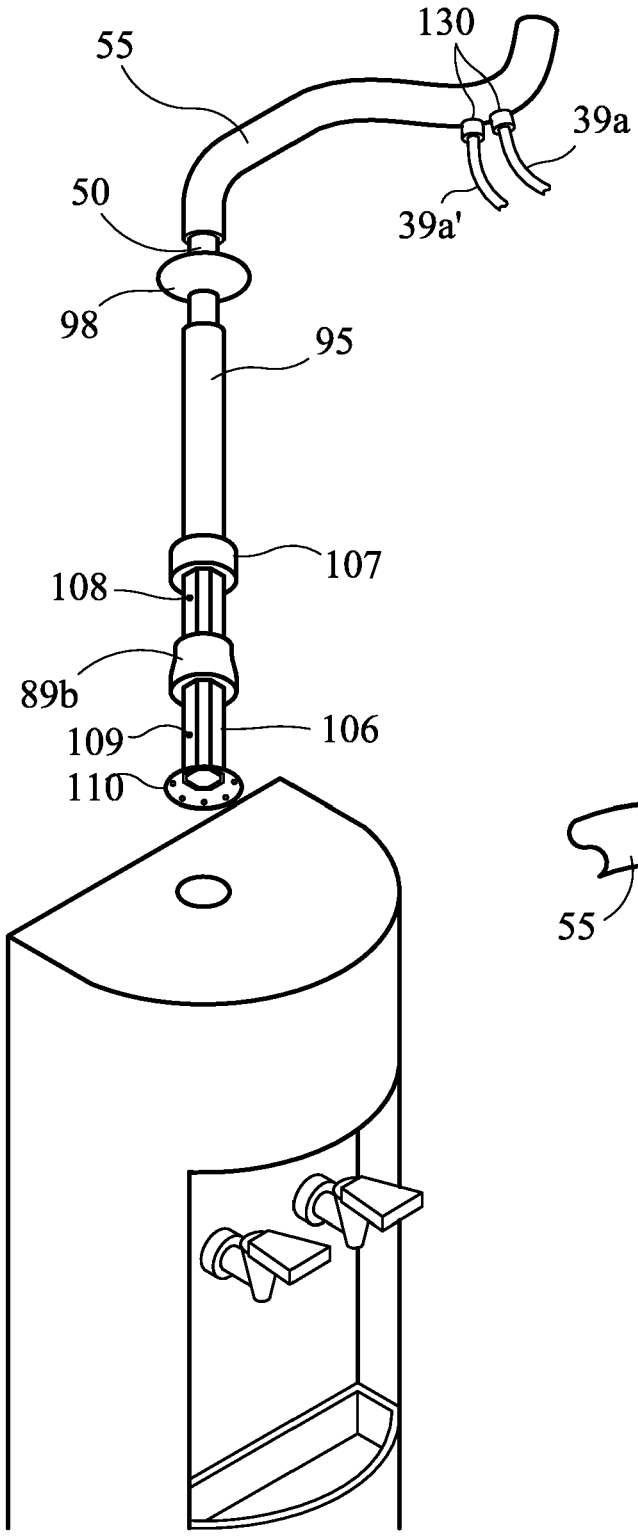
FIG. 6A is a perspective view of a fill control assembly connected to a distal sleeve and flexible extension with the pump housing eliminated for convenient viewing.

The fill control assembly 36 includes a filler pipe 106 having an hexagonal exterior cross section, with proximal and distal ends. A filler coupling 107, is mounted at the proximal end of the filler pipe 106, and is connected to the filler tube 95 to form a water tight fluid conduit through the filler tube 95 and into the filler pipe 106. A first filler float 89*b* is slidably disposed on the filler pipe 106. The first filler float 89*b* is preferably a duplicate of the supply float 89*a* and includes a second magnet 90*b*. An upper filler sensor 108 is mounted on the exterior surface of the filler pipe 106 and connected to the first pair of fill control assembly wires 39*a* inside the filler pipe 106. It is preferred that the arrangement of the fill control assembly 36 be similar to that of the low water shut-off assembly 37, with the filler pipe 106 retained in a generally vertical orientation, as described above and shown in FIGS. 5A and 6A. The first filler float 89*b* is slidably disposed on the filler pipe 106 so as to rise with a rising water level, but not to rotate, in the water cooler reservoir. The upper filler sensor 108 is to be positioned so that a signal, from the upper filler sensor 108 will be transmitted when the water level reaches a pre-selected maximum. The filler control assembly wires 39*a* are electrically connected to the relay 38, in a conventional manner such that the relay 38 will de-energize the pump 5 when the signal is received. A lower filler sensor 109 is mounted on the filler pipe 106 and is electrically connected, in a conventional manner to the relay 38, by a second pair of fill control assembly wires 39*e*. The lower filler sensor 109 is configured to energize the pump when the water level in the reservoir reaches a pre-selected minimum. The filler pipe 106 is provided with a second foot 110, also provided with vents 93, mounted at the distal end to act as a stop for the first filler float 89*b*. A second filler float 89*c* may also be slidably disposed on the filler pipe 106, as shown in FIG. 5B. It is preferred that a separator 115 be included to slildably confine the first filler float 89*b* proximate to the upper sensor 108 and the second filler float 89*c* proximate to the lower sensor 109, respectively.

The fill control assembly 36 will allow the pump 5 to operate until the water level in the reservoir reaches the pre-selected maximum level, at which point the upper filler sensor 108 will signal the relay and shut off the pump 5. As the water cooler is tapped, causing the water level to descend, the first filler float 89*b* will move downward, with the water level. When the water level reaches the pre-selected minimum level, the first filler float 89*b* comes into close proximity to the lower filer sensor 109, which responds with a signal to the relay 38 to energize the pump 5. The fill control assembly 36 automatically energizes the pump 5 to replenish the water in the reservoir, unless the signal is initiated from the low water shut-off assembly 37 to stop the pump 5 and prevent damage to the pump 5. The system will operate automatically to transfer water from a supply bottle as needed. The system will shut down when the supply bottle is empty and resume operation when the empty bottle is replaced.

Figure 7:
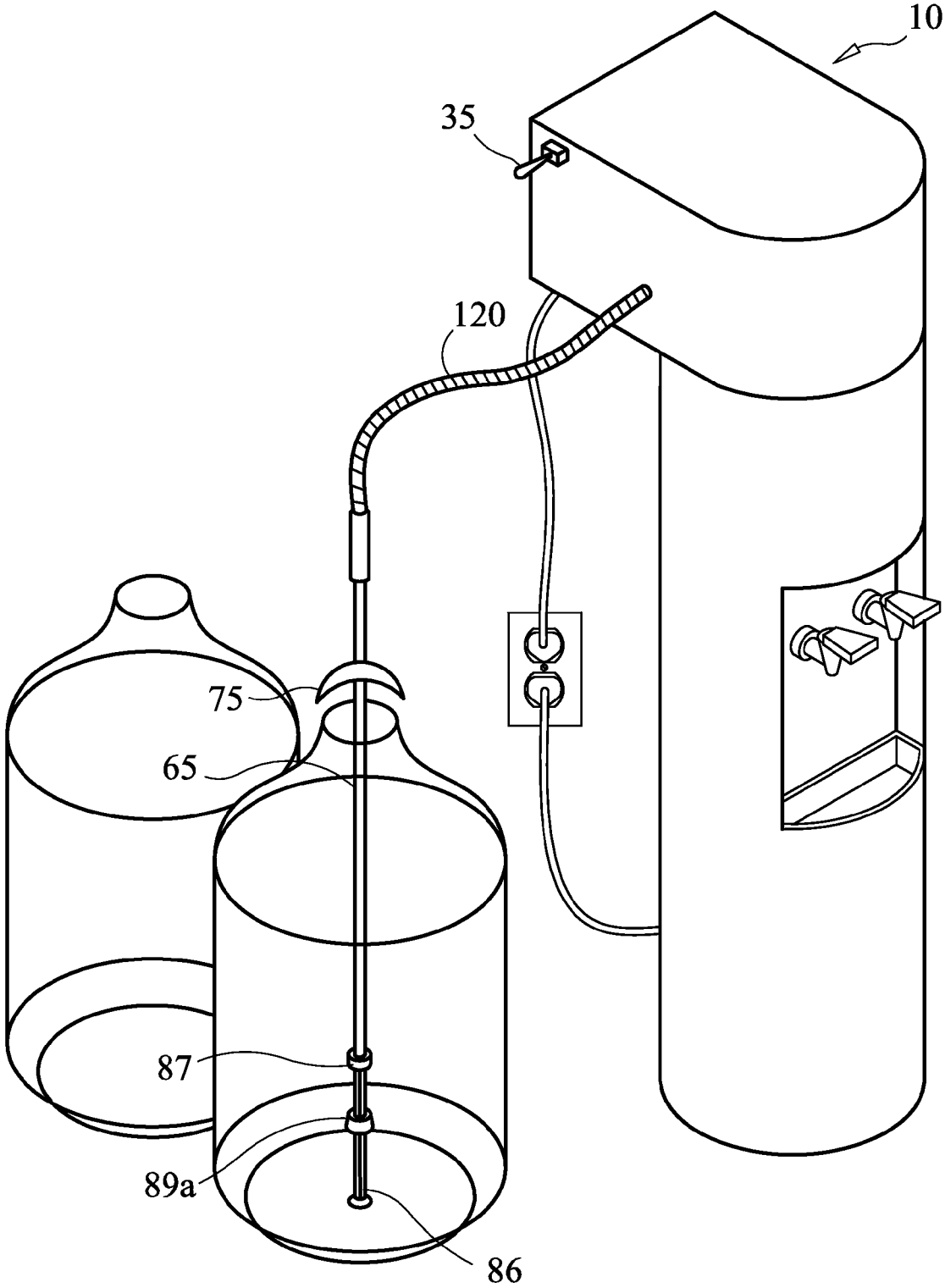
FIG. 7 is a perspective view of the system of the present invention, mounted on a water cooler and with an expandable supply hose installed.

In an alternate version of the present invention, the supply hose 80 is replaced by an expandable supply hose 120, which is formed with a plurality of aligned and spaced apart rigid rings embedded in a flexible body having folds disposed in a one-to-one correspondence with the spaces between the rigid rings. The expandable supply hose 120 is shown in FIG. 7 and may be expanded in the manner of a conventional vacuum cleaner hose to reach a water supply bottle at a more distant location. The expandable supply hose 120 allows a number of water supply bottles to be tapped by the system of the present invention without the need for shuffling the positions of the bottles.

Figure 6B:
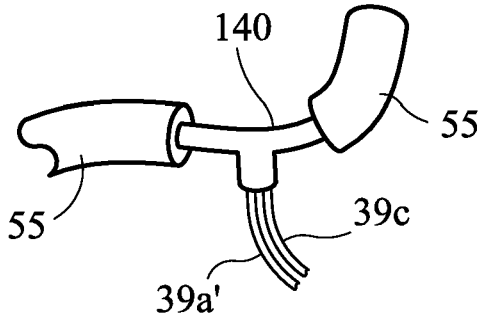
FIG. 6B is a fragmentary view of a flexible segment showing an alternate embodiment.

It is preferred that the low water shut-off assembly wires 39*b* be disposed inside the supply pipe 86 and extend through the supply tube 65 and into the flexible segment 55 extending from the inlet port 15. The shut-off assembly wires 39*b* exit the flexible segment 55 and connect to the relay 38, in side the housing 10. A bung 130 surrounds the wires and seals the exit path from the flexible segment 55, as shown in FIG. 1. It is preferred that the exit point be sealed with silicone or similar sealant to maintain watertight integrity of the fluid conduit. Likewise, the fill control assembly wires 39*a* and 39*a*' are disposed inside the filler pipe 106 and extend through the filler tube 95 and into the flexible segment 55 extending from the outlet port 20. The filler control assembly wires 39*a* and 39*a*' exit the flexible segment 55 and connect to the relay 38, being also surrounded by a bung 130 and sealed, in the same manner, shown in greater detail in FIG. 6A. Alternatively, a "T" shaped joint may be inserted at a break formed in the flexible segment 55, as shown in FIG. 6B, so that wires may exit through the perpendicular projection. The "T" joint is preferably sealed with silicone, in a conventional manner.

The supply tube 65 and the filler tube 85 are preferably provided with a plurality of spaced apart lateral ridges encircling the proximal ends, to improve frictional engagement with the supply hose 80 and the distal sleeve 50, respectively.

While the preferred embodiment of the present invention has been described herein, together with several contemplated variations, it may be understood and appreciated that other various modifications can be made in the invention and that the appended claims are intended to cover all such modifications which fall within the spirit and scope of the invention disclosed and claimed herein.

What is claimed is:

1. A water cooler replenishing system for automatically replenishing a reservoir inside a freestanding water cooler from a conventional water supply bottle, comprising:

a fluid pump, an inlet port and an outlet port;

said inlet port and said outlet port being operatively connected in fluid communication with said pump;

said pump having selective powering means and automatic control means for operating said pump to urge water inward from said inlet port and outward through said outlet port;

water collecting means disposed within said water supply bottle;

a watertight fluid conduit from said water collecting means to said inlet port;

a fill control assembly disposed within said reservoir;

a watertight fluid conduit from said outlet port to said fill control assembly;

said powering means includes an electrical switch and said automatic control means includes a relay;

said water collecting means including a supply tube having proximal and distal ends, the distal end being sized to pass into said conventional water supply bottle, for collecting water therefrom;

said fill control assembly comprises a vertically oriented filler pipe having at least one filler sensor electrically connected to said relay and at least one float configured for vertically traversing said filler pipe;

said float having means for inducing said filler sensor to transmit a signal to said relay to control said pump said fill control assembly being configured to detect at least one pre-selected water level in said reservoir and to respond by transmitting a signal to said automatic control means;

said automatic control means being configured to receive said signal and respond by controlling said pump;

to automatically collect water from said conventional water supply bottle and deliver water to said reservoir for replenishing said freestanding water cooler.

2. The water cooler replenishing system of claim 1 wherein:

said at least one sensor comprises an upper sensor and a lower sensor;

said upper sensor being positioned and configured to detect a pre-selected maximum water level and to transmit a signal to said relay for shutting off said pump;

said lower sensor being positioned and configured to detect a pre-selected minimum water level and to transmit a signal to said relay for turning on said pump.

3. The water cooler replenishing system of claim 2 wherein:

said at least one float comprises a first filler float and a second filler float; said first filler float being slideably confined for moving into and out of close proximity to said upper sensor;

said second filler float being slidably confined for moving into and out of close proximity to said lower sensor.

4. The water cooler replenishing system of claim 1, further including a low water shut-off assembly disposed in said supply bottle for detecting a low water condition and shutting off said pump, to avoid damage.

5. The water cooler replenishing system of claim 4 wherein said low water shut-off assembly comprises:

a vertically oriented supply pipe having a supply sensor electrically connected to said relay;

a supply float being configured for traversing said supply pipe and having means for inducing said supply sensor to transmit a signal to said relay, for shutting off said pump.

6. The water cooler replenishing system of claim 1 wherein said watertight fluid conduit from said water collecting means to said inlet port includes a supply hose having a plurality of spaced apart and aligned rigid rings embedded in a flexible body for expanding and contracting the length of said supply hose to extend the reach.

7. A process for automatically replenishing a reservoir inside a free standing water cooler from a conventional water supply bottle comprising the steps of:

providing a fluid pump with an inlet port and an outlet port;

providing operative connection and fluid communication between said inlet port and said pump and between said pump and said outlet port;

providing selective powering means and automatic control means for operating said pump to urge water inward from said inlet port and outward through said outlet port;

providing water collecting means disposed within said water supply bottle;

providing a watertight fluid conduit from said water collecting means to said inlet port;

providing a fill control assembly disposed within said reservoir;

providing a watertight fluid conduit from said outlet port to said fill control assembly;

said powering means includes an electrical switch and said automatic control means includes a relay; said water collecting means includes a supply tube having proximal and distal ends, the distal end being sized to pass into said conventional water supply bottle, for collecting water therefrom;

said fill control assembly comprises a vertically oriented filler pipe having at least one filler sensor electrically connected to said relay and at least one float configured for vertically traversing said filler pipe:

said float having means for inducing said filler sensor to initiate a signal to said relay to control said pump;

said fill control assembly being configured to detect at least one pre-selected water level in said reservoir and to respond by transmitting a signal to said automatic control means;

said automatic control means being configured to receive said signal and respond by controlling said pump;

powering said pump under automatic control of said automatic control means to collect water from said conventional supply bottle and deliver water to said reservoir for replenishing said free standing water cooler.

8. The process of claim 7 wherein said at least one sensor comprises an upper sensor and a lower sensor;

said upper sensor being positioned and configured to detect a pre-selected maximum water level and to transmit a signal to said relay for shutting off said pump;

said lower sensor being positioned and configured to detect a pre-selected minimum water level and to transmit a signal to said relay for turning on said pump.

9. The process of claim 8 wherein said at least one float comprises a first filler float and a second filler float; said first filler float being slideably confined for moving into and out of close proximity to said upper sensor;

said second filler float being slidably confined for moving into and out of close proximity to said lower sensor.

10. The process of claim 7 further including, following the step of providing a fill control assembly, the step of providing a low water shut-off assembly disposed in said supply bottle, for detecting a low water condition and shutting off said pump, to avoid damage.

11. The process of claim 10 wherein:

said low water shut-off assembly comprises a vertically oriented supply pipe having a supply sensor electrically connected to said relay;

a float being configured for traversing said supply pipe and having a sensor configured to induce said supply sensor to transmit a signal to said relay, for shutting off said pump.

* * * * *